US009567837B2

(12) United States Patent
O'Brien et al.

(10) Patent No.: US 9,567,837 B2
(45) Date of Patent: Feb. 14, 2017

(54) TUBULAR CONNECTION

(71) Applicant: Schlumberger Technology Corporation, Sugar Land, TX (US)

(72) Inventors: Daniel O'Brien, Stonehaven (GB); Andrew John Joseph Gorrara, Stonehaven (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 610 days.

(21) Appl. No.: 13/928,447

(22) Filed: Jun. 27, 2013

(65) Prior Publication Data

US 2014/0008081 A1 Jan. 9, 2014

(30) Foreign Application Priority Data

Jul. 6, 2012 (GB) ..... 1212053.1
Jan. 10, 2013 (GB) ..... 1300442.9

(51) Int. Cl.
*E21B 43/10* (2006.01)
*E21B 41/00* (2006.01)
*E21B 19/16* (2006.01)

(52) U.S. Cl.
CPC ..... *E21B 43/106* (2013.01); *E21B 19/16* (2013.01); *E21B 41/00* (2013.01); *E21B 43/103* (2013.01); *E21B 43/108* (2013.01)

(58) Field of Classification Search
CPC ..... E21B 43/103; E21B 43/106
See application file for complete search history.

(56) References Cited

U.S. PATENT DOCUMENTS

| | | | | |
|---|---|---|---|---|
| 7,017,670 | B2 | 3/2006 | Hazel et al. | |
| 8,020,625 | B2 | 9/2011 | Ring et al. | |
| 8,291,986 | B2 | 10/2012 | Gorrara et al. | |
| 2004/0090068 | A1* | 5/2004 | Evans | E21B 17/042 285/382 |
| 2006/0237188 | A1 | 10/2006 | McMahan | |
| 2009/0205843 | A1* | 8/2009 | Gandikota | E21B 33/1208 166/387 |
| 2010/0230958 | A1* | 9/2010 | Holland | E21B 43/106 285/333 |
| 2012/0227984 | A1 | 9/2012 | Thomson | |

FOREIGN PATENT DOCUMENTS

| | | |
|---|---|---|
| GB | 2474692 | 4/2011 |
| GB | 2501417 A | 10/2013 |
| WO | WO 01/18354 | 3/2001 |
| WO | WO 02/059452 A1 | 8/2002 |

* cited by examiner

*Primary Examiner* — David Andrews
*Assistant Examiner* — Tara Schimpf
(74) *Attorney, Agent, or Firm* — Michael Stonebrook

(57) ABSTRACT

Apparatus and method for connecting tubular members in a wellbore. A host tubular member has reinforcing annular members mounted thereon to provide regions of differing resistance to the radial load. When the host tubular member is expanded radially outwardly, within a second tubular member, each weaker region starts expanding first and seals the host tubular member against the second tubular member prior to the stronger region. Embodiments of host tubular members are described including members of progressive resistance, split rings, gripper elements and sealing elements.

17 Claims, 2 Drawing Sheets

TUBULAR CONNECTION

FIELD OF THE INVENTION

The present invention provides an apparatus and a method for connecting tubular members in a wellbore and in particular provides an apparatus and a method for sealing and/or securing a first (inner) tubular to a second (outer) tubular in a wellbore and thereby providing an annular seal between the first and second tubular members.

BACKGROUND TO THE INVENTION

In wellbore drilling and completion, various tubular elements (also typically referred to in the industry as "tubulars") need to be connected to each other. For example, in well completions, liner strings may have to be connected end to end in order to line the wellbore to the required depth. In some cases, one tubular has to be set inside another tubular by increasing the diameter of the inner tubular until it contacts the inner wall of the outer tubular and creates an interference fit therewith. The connection between the tubulars very often must be capable of withstanding axial loads (i.e. secured). The connection should also be fluid tight to provide an annular barrier between the tubulars (i.e. sealed) to prevent fluid passage between the internal bore of the outer tubular and the exterior of the inner tubular.

One arrangement for connecting tubular members in a wellbore is described in WO2011/048426 A2 and includes a metal to metal seal between first and second tubular members 1, 2 in a cased wellbore, as shown in FIGS. 1 and 2 of the present application. The second (lower) tubular member 2 includes an upper end portion 21 which has a greater inner diameter than the outer diameter of a lower end portion 11 of the first (upper) tubular member 1. Circumferential recesses or grooves 22 are formed on the inner surface or bore of the upper end portion 21 of the second (lower) tubular member 2. In order to form the seal, firstly, the lower end portion 11 of the first tubular member 1 is located within the upper end portion 21 of the second tubular member 2. Next, a hydraulic expansion tool 3 is lowered from surface inside the first tubular member 1 to the intended location of the seal (see FIG. 2 of the present application). The tool 3 seals off a chamber 7 between a pair of axially spaced apart seals 8. Actuation of the hydraulic expansion tool 3 causes chamber 7 to be filled with fluid under high pressure, and this high pressure fluid acts on the inner surface or bore of the lower end portion 11 of the first tubular member 1 to first elastically and then plastically expand so that the lower end portion 11 expands radially outwardly along a length bounded by the seals 8 into the recesses 22 on the inner bore of the second tubular member 2 such that circumferential protrusions 12 or ridges are formed on the outside of the lower end portion 11 of the first tubular portion 1. These protrusions 12 are received in the recesses 22 until a seal is formed between the first and second tubular members 1, 2.

The problem associated with the above described arrangement is that well fluid present at the interface between the tubular members may become trapped in the recesses which can lead to the formation of hydraulic lock which is potentially damaging to the tubular members and/or means that an effective seal is not formed. In addition, the circumferential recesses or grooves must be preformed or machined and set in the wellbore at a suitable depth prior to any connection being made.

A solution to above described problem is described in EP2013445 B1 and illustrated in FIG. 3 of this present application. In EP2013445 B1, a first (inner) tubular member 4 is expanded into a second (outer) tubular member 5 using the same expansion tool 3 as in FIGS. 1 and 2 which seals off a chamber 7 with axially spaced apart seals 8. The first tubular member 4 has an expandable portion 40 which has a central section 41 and end regions 42. The wall thickness of the central section 41 is relatively uniform and is thinner than the wall thickness of the end regions 42. Tapered portions 43 provide transitional regions between the thinner wall of the central section 41 and the thicker end regions 42. When the tool 3 is actuated, the central section 41 expands prior to the end regions 42 due to the former's thinner sidewall thickness, thereby driving any fluid at the annular interface between the outer surface of the first and the inner surface of the second tubular members 4, 5 in opposite directions axially beyond the end regions 42 into the annular space 9. Seals 6 at the end regions 42 on the outside of the first tubular member 4 provide an additional fluid barrier between the tubular members 4, 5 when the expandable portion 40 has been fully expanded. Since the seals 6 make contact with the second tubular member 5 only after the fluid has been expelled from the interface between the tubular members 4, 5, the occurrence of a hydraulic lock is avoided.

A drawback associated with the above-described arrangement of EP2013445B1 is that the tubular members between which the seal connection is made in those arrangements have relatively complicated profiles, particularly the first (inner) tubular member 4 due to its varying sidewall thickness which result in relatively high manufacturing costs. In addition, the performance of such a connection is limited due to the limited means of modifying the single piece assembly.

Accordingly, the object of the present invention is to provide an expandable tubular connection which is relatively inexpensive to manufacture whilst being capable of providing a reliable hermetic seal and/or being capable of creating a secure connection through which axial force can be transferred and therefore resist relative axial movement occurring. In addition, the object of the present invention is to provide an expandable tubular connection which can be readily adapted to suit different applications.

SUMMARY OF THE INVENTION

According to a first aspect of the invention there is provided an apparatus for connecting tubular members in a wellbore, the apparatus comprising

- a host tubular member for sealingly connecting with a second tubular member, the host tubular member comprising:—
- an expandable portion adapted to be placed within the second tubular member and being expandable radially outwardly against the second tubular member until one or more sealed joints are formed between the expandable portion and the second tubular member;
- the expandable portion comprising one or more reinforcing annular members mounted around the expandable portion;
- the or each annular member providing resistance to radial load and defining on the expandable portion annular regions having differing resistance to the radial load whereby the or each region having lower resistance expands prior to the or each region having greater resistance when the expandable portion is subjected to radial outward expansion.

The outward expansion may be achieved, for example, by application of radial outward pressure or force to side walls of the expandable portion within an inner bore of the expandable portion.

Preferably, the expandable portion comprises one or more reinforcing annular members mounted around the outer circumference of at least a portion of the axial length of the expandable portion.

Thus, in use, when the expandable portion of the host tubular member is expanded radially outwardly, the or each region having greater resistance (hereinafter referred to as "stronger region" for brevity) resists radial expansion more than the or each region having lower resistance (hereinafter referred to as "weaker region" for brevity), such that the or each weaker region starts expanding first and seals the host tubular member against the second tubular member prior to the stronger region.

In a preferred embodiment, a plurality of annular members are arranged in a predetermined sequence so that the resistance of each subsequent annular member increases progressively in a predetermined manner so that the expandable portion starts expanding at the weakest region first and continues to expand sequentially towards the strongest region. For example, in one arrangement, the resistance of each subsequent annular member increases progressively from a middle region of the expandable portion towards outer ends of the expandable portion; or, in another arrangement, from one end of the expandable portion towards another.

The provision of the or each annular member as a separate device mounted on or otherwise fixed to the host tubular member after the host tubular member has been manufactured, makes it possible for the host tubular member or at least the expandable portion thereof to have a substantially uniform wall thickness and/or uniform diameter, whether internal or external or both. Thus, the host tubular member can be manufactured more easily and at a lower cost compared to prior art expandable tubular members. Accordingly, in a preferred embodiment, the host tubular member or at least the expandable portion thereof has a uniform wall thickness and/or a uniform diameter whether internal or external or both. It is however envisaged that the host tubular member can be profiled. Furthermore, the annular members can be arranged as desired on the host tubular member after the host tubular member has been manufactured, thereby making it possible to vary the configuration of the expandable portion according to particular technical requirements. Moreover, the annular members themselves are relatively easy to manufacture.

The arrangement of the annular members in the predetermined sequence so that their resistance increases progressively causes fluid to be continuously expelled from the interface between the expandable portion and the second tubular member as the expandable portion expands, so that by the time the strongest region expands all the fluid has been forced out, thereby preventing the occurrence of a hydraulic lock.

In a preferred arrangement, the host tubular member is configured to expand inside the second tubular member to seal against an inner surface of the second tubular member.

The so formed sealed joint between the host tubular member and the second tubular member has the ability to withstand axial loads and fluid pressures acting between the host tubular member and the second tubular member. The sealed joint preferably creates both a mechanical fixing between the two tubulars and also a hermetic seal between the host tubular member and the second tubular member. Preferably, the expandable portion of the host tubular member and the second tubular member comprise metallic portions which form a metal-to-metal sealed joint when the expandable portion is expanded against the second tubular member. Preferably, the sealed joint is formed as a result of initially elastic and then plastic deformation of the material of at least the expandable portion and, preferably also the second tubular member.

In one arrangement, the or each annular member comprises a ring or a band. The ring may comprise, for example, a complete ring or a split ring.

In a preferred arrangement, the or each annular member is mounted externally around the host tubular member.

The or each annular member is preferably fixed on the host tubular member in a suitable manner, such as, for example, but not limited thereto, via interference fit, welding, threaded connection, or some other method, or can be held in place by an external device.

The or each annular member may be installed by being slid over the host tubular member or by being clamped radially around the host tubular member.

The or each annular member may be made, for example, from metal, ceramics, elastomeric or composite material. The or each annular member can comprise an assembly of annular sub-members.

The resistance to radial load of the or each stronger and weaker regions can be adjusted by, for example, varying radial thickness or axial length, or the overall size and shape, of the or each annular member, varying axial spacing between each annular member, varying the material of the annular member, providing the or each annular member with other elements influencing the strength of the or each annular member, or a combination of the above.

In a preferred arrangement, one or more annular gripper elements are mounted on the expandable portion for resisting axial and/or rotational movement of the host tubular member by gripping an inner surface of the second tubular member housing the host tubular member.

Further preferably, one or more sealing elements are mounted on the expandable portion to provide an additional fluid and pressure seal.

In a preferred arrangement, a plurality of annular members are arranged axially spaced apart on the expandable portion to define annular recesses between the annular members. Each annular recess preferably has sides defined by end portions of adjacent annular members and a base defined by an intermediate portion of the host tubular member bounded by the adjacent annular members. Preferably, the annular recesses are sized and shaped such that resistance to radial load of the intermediate portion of the host tubular member between two adjacent annular members matches or corresponds to the resistance to radial load of at least one of the adjacent annular members. Further preferably, the resistance to radial load of the intermediate portion of the host tubular member between two adjacent annular members is selected from the range of resistances to radial load from equal or greater than the resistance of that annular member of the two adjacent annular members which has the lower resistance to radial load to equal or less than the resistance of that annular member which has the greater resistance. Accordingly, the resistance of each subsequent annular member and a subsequent recess on the expandable portion increases progressively so that the expandable portion as a whole starts expanding at the weakest region first and continues to expand sequentially towards the strongest region. The resistance to radial load of the intermediate portion of the host tubular member can be adjusted by, for example, varying axial spacing between adjacent annular members thereby varying the axial length of the intermediate portion and hence its radial strength, providing the or each intermediate portion with other elements influencing the strength of the intermediate portion, or a combination of the above.

In a preferred arrangement, gripper elements and/or sealing elements are mounted in the annular recesses, preferably, so that gripper elements alternate with sealing elements. The gripper elements and/or sealing elements may be configured to influence the overall resistance to radial load of the intermediate region of the host tubular member between two adjacent annular members.

The or each gripper elements and the or each sealing elements may be made, for example, from metal, ceramics, elastomeric or composite material. Other materials, such as, for example, syntactic foam may improve sealing performance of the or each sealing elements by providing potential extra volume in the annular recess by excluding fluid between the adjacent annular members and allowing the host tubular member to expand further, by, for example, crushing the foam and increasing the interface pressure between the host tubular member, the sealing element and the second tubular member. Also, other materials, such as, for example, syntactic foam, may improve gripping performance of the or each gripping element by providing potential extra volume in the annular recess by excluding fluid between the adjacent annular members and allowing the host tubular member to expand further, by, for example, crushing the foam and increasing the interface pressure between the host tubular member, the gripping element and the second tubular member.

The or each gripper elements may comprise, for example, a complete ring or a split ring, the latter providing weaker resistance to radial load than a complete ring. A retaining arrangement is preferably provided for holding a split ring in position, such as, for example, comprising one or more of a spring, an additional ring, radially projecting inward or outward protrusions, keys or keyways mating with corresponding keyways or keys in neighbouring components, for example the or each annular ring. In another arrangement, in order to make the or each gripper elements weaker, one or more slots, preferably, substantially axial slots are formed in one or both ends of the or each gripper element. The or each gripper element may be configured to engage the host tubular member and/or the second tubular member via an interference fit created between the gripper element and the host tubular member and or the second tubular member. Alternatively or additionally, the or each gripper element may be configured to engage the host tubular member and/or the second tubular member via one or more angled faces. The host tubular member or the second tubular member may comprise profiled or roughened surfaces to facilitate resistance to axial and radial displacement of the host tubular member.

The or each sealing elements may comprise, for example, a complete ring or a split ring profiled in an appropriate way to create a seal between itself and the host tubular member and itself and the second tubular member. The or each sealing elements may be provided, for example, in the form of a Wills Ring™. The or each sealing element may be configured to engage the host tubular member and/or the second tubular member via an interference fit created between the sealing element and the host tubular member and or the second tubular member.

Preferably, a retaining arrangement is provided at one or each end of the expandable portion for keeping the or each annular members, and, if applicable, the or each gripping elements and the or each sealing elements in their respective positions on the expandable portion. In one arrangement, the retaining arrangement is provided in the form of one or more retaining nuts fastened to the host tubular member via a suitable fastening arrangement, such as, for example, but not limited thereto, one or more of screw threads, locking nuts, weld joint.

In variations of the invention, the expandable portion may be placed concentrically within the second tubular member.

The expandable portion can be expanded by an appropriate tool, such as for example a conventional prior art hydraulic expansion tool, a cone displacement tool, rollers, or any other tool capable of increasing the inner diameter of the expandable portion.

If a hydraulic expansion tool in particular is used, the or each annular member can be profiled or channelled to facilitate fluid expulsion.

The host tubular member could be any sort of tubing used downhole, for example, casing, liner or production tubing, etc. which needs to be expanded against the inner surface or bore of another larger diameter tubing.

There may be a tubular assembly comprising:—

- a host tubular member for sealingly connecting with a second tubular member, the host tubular member comprising:—
- an expandable portion adapted to be placed within the second tubular member and being expandable radially outwardly against the second tubular member until one or more sealed joints are formed between the expandable portion and the second tubular member;
- the expandable portion comprising one or more reinforcing annular members mounted around the expandable portion;
- the or each annular member providing resistance to radial load and defining on the expandable portion annular regions having differing resistance to the radial load whereby the or each region having lower resistance expands prior to the or each region having greater resistance when the expandable portion is subjected to radial outward expansion; wherein
- the expandable portion has been expanded radially outwardly against the second tubular member and one or more sealed joints have been formed between the expandable portion and the second tubular member.

There may be a kit of parts including an apparatus for connecting tubular members in a wellbore, the apparatus comprising—

- a host tubular member for sealingly connecting with a second tubular member, the host tubular member comprising:—
- an expandable portion adapted to be placed within the second tubular member and being expandable radially outwardly against the second tubular member until one or more sealed joints are formed between the expandable portion and the second tubular member;
- the expandable portion comprising one or more reinforcing annular members mounted around the expandable portion;
- the or each annular member providing resistance to radial load and defining on the expandable portion annular regions having differing resistance to the radial load whereby the or each region having lower resistance expands prior to the or each region having greater resistance when the expandable portion is subjected to radial outward expansion; and the second tubular member to be sealed with the host tubular member.

There may also be a method of manufacturing an apparatus for connecting tubular members in a wellbore, the method comprising the steps of (a) providing a host tubular member for sealingly connecting with a second tubular member, the host tubular member comprising:— an expandable portion adapted to be placed within the second tubular member and being expandable radially outwardly against the second tubular member until one or more sealed joints are formed between the expandable portion and the second tubular member; and (b) mounting one or more reinforcing annular members around the expandable portion;

the or each annular member providing resistance to radial load and defining on the expandable portion annular regions having differing resistance to the radial load whereby the or each region having lower resistance expands prior to the or each region having greater resistance when the expandable portion is subjected to radial outward expansion.

According to a second aspect of the invention there is provided a method of connecting tubular members in a wellbore, the method comprising the steps of:—

(a) providing a host tubular member for sealingly connecting with a second tubular member, the host tubular member comprising an expandable portion comprising one or more reinforcing annular members mounted around the expandable portion;

the or each annular member providing resistance to radial load and defining on the expandable portion annular regions having differing resistance to the radial load whereby the or each region having lower resistance expands prior to the or each region having greater resistance when the expandable portion is subjected to radial outward expansion;

(b) placing the expandable portion within the second tubular member; and (c) expanding the expandable portion radially outwardly against the second tubular member until one or more sealed joints are formed between the expandable portion and the second tubular member.

All essential, preferred or optional features of the first aspect of the present invention can be provided in conjunction with the second aspect of the present invention where appropriate.

DETAILED DESCRIPTION OF THE INVENTION

Embodiments of the present invention will now be described, by way of example only, with reference to the accompanying drawings in which.

Figure 3:
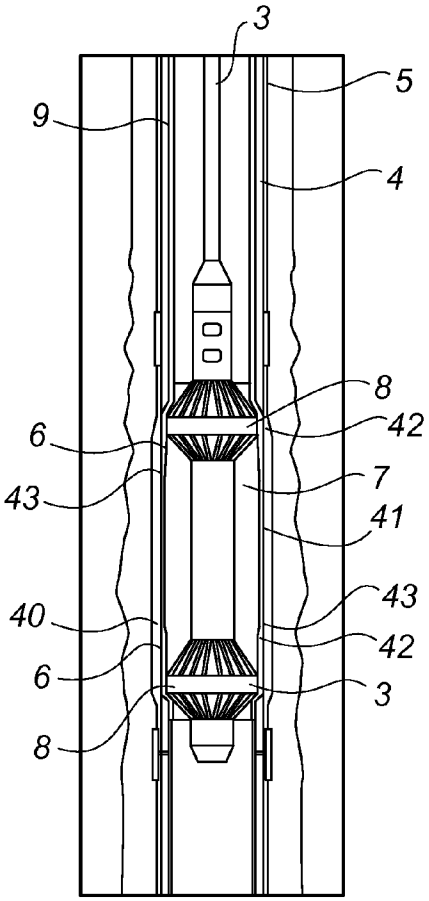
Fig. 3 (PRIOR ART)
FIG. 3 is a sectional side view of a further prior art method of connecting tubular members and do therefore not form part of the present invention.
Figure 2:
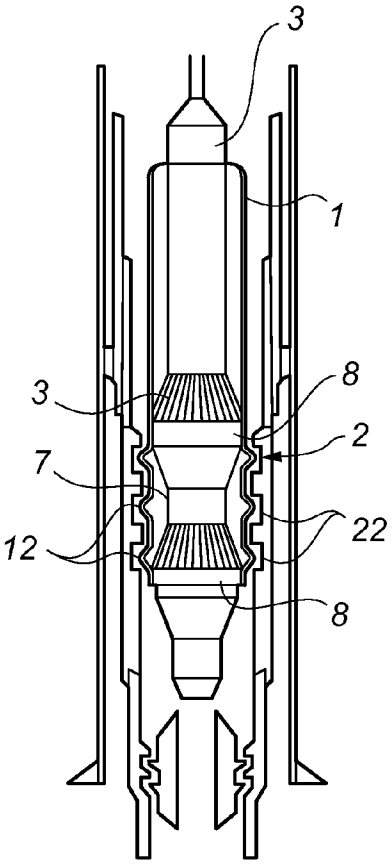
Fig. 2 (PRIOR ART)
FIGS. 1 and 2 are sectional side views of stages of a prior art method of connecting tubular members and do therefore not form part of the present invention.
Figure 1:
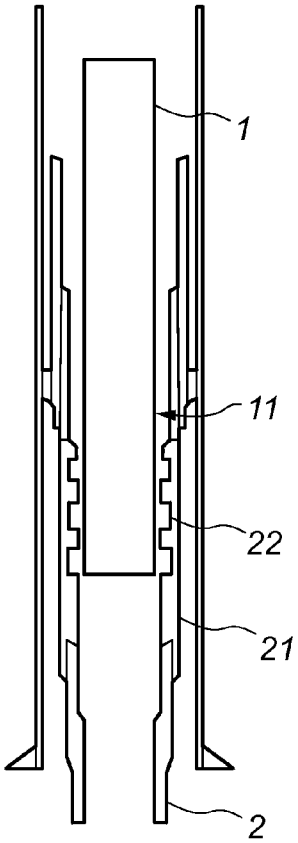
Fig. 1 (PRIOR ART)
Figure 4:
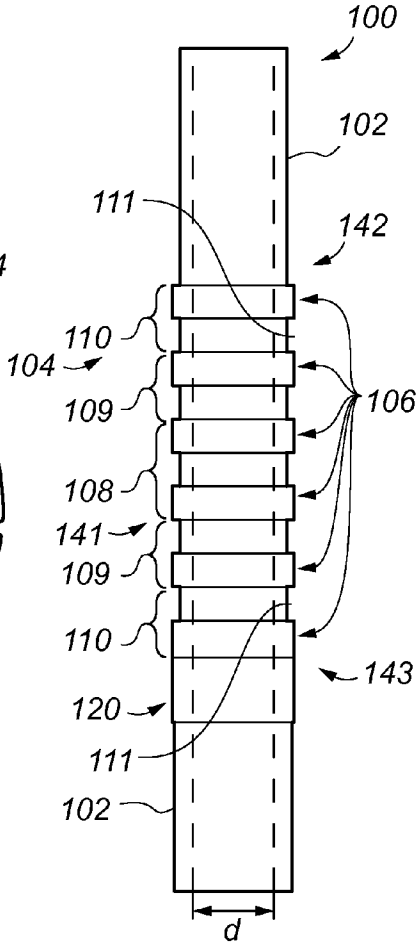
FIG. 4 is a schematic side view of a host tubular member of an apparatus for connecting tubular members according to the present invention.

Referring initially to FIG. 4 an apparatus for connecting tubular members in a wellbore in accordance with the four aspects of the present invention is indicated generally by reference numeral 100. The apparatus 100 comprises a host tubular member 102 for sealingly connecting with a second tubular member (not shown), such as, for example, an outer tubular member 5 shown in FIG. 3. The host tubular member 102 comprises an expandable portion 104 adapted to be placed inside the second tubular member and expanded radially outwardly using an expansion tool, such as for example a prior art tool 3, shown in FIG. 2 or FIG. 3, against an inner surface of the second tubular member until one or more sealed joints (not shown) are formed between the expandable portion 104 and the second tubular member. Other tools, such as a cone displacement tool, rollers, or any other tool capable of increasing inner diameter of the expandable portion can in principle be used.

The expandable portion 104 comprises a plurality of reinforcing annular members in the form of rings 106 mounted around the exterior of the expandable portion 104 spaced along the expandable portion 104 to define annular recesses 111. The rings 106 and recesses 111 provide resistance to radial load acting on the expandable portion 104 expansion tool when the tool expands the expandable portion 104.

In FIG. 4, the rings 106 are arranged in a predetermined sequence so that the resistance to radial loads of each subsequent annular member 106 increases progressively from a middle region 141 of the expandable portion 104 towards opposite ends 142, 143 of the expandable portion 104. The rings 106 and recesses 111 define on the expandable portion 104 annular regions 108, 109, 110 having differing resistance to the radial load. The regions 108 have lower resistance and thus start expanding before the regions 109 which have greater resistance when the expandable portion 104 is subjected to radial outward expansion. The regions 109 have still lower resistance than regions 110 and thus regions 109 start expanding before the regions 110. Thus, the weaker regions 108 seal against the inner surface or bore of the second tubular member before the stronger regions 109 and 110 and the stronger regions 110 are the last to expand. Rings 106 may have different strengths R, different widths W or different thickness T, and the spacing S between the rings 106 (i.e. axial width of the recesses 111) may be different. The combination of R, W, T and S is calculated so that area 108 has less resistance to radial force than region 109, which in turn has less resistance than region 110 to cause the expandable portion 104 as a whole to expand progressively.

The rings 106 are separate devices and are mounted on the host tubular member 102 after the host tubular member 102 has been manufactured, making it possible for the host tubular member 102 or at least the expandable portion 104 to have a substantially uniform wall thickness and uniform inner diameter d and therefore also a substantially uniform outer diameter along its entire length. Thus, the host tubular member 102 can be manufactured more easily and at a lower cost compared to prior art expandable tubular members. The rings 106 can be arranged as desired on the host tubular member 102 after the host tubular member 102 has been manufactured, thereby making it possible to vary the configuration of the expandable portion according to particular technical requirements. The rings 106 themselves are relatively easy to manufacture as they can in their simplest form have a substantially uniform wall thickness and a uniform inner diameter (which may be smaller than, slightly greater or somewhat greater than the outer diameter of the host tubular member 102).

The sealed joint formed between the host tubular member 102 and the second tubular member has the ability to withstand axial loads and fluid pressures acting between the host tubular member 102 and the second tubular member. The sealed joint creates a mechanical fixing and a hermetic seal between the host tubular member 102 and the second tubular member. The expandable portion 104, the rings 106, and the second tubular member may be made from metal or at least comprise metallic portions which form a metal-to-metal sealed joint when the expandable portion 104 is expanded against the second tubular member. The sealed joint is formed as a result of initially elastic and then plastic deformation of the material of one or each of the expandable portion 102, including the rings 106, and possibly the second tubular member.

Figure 5:
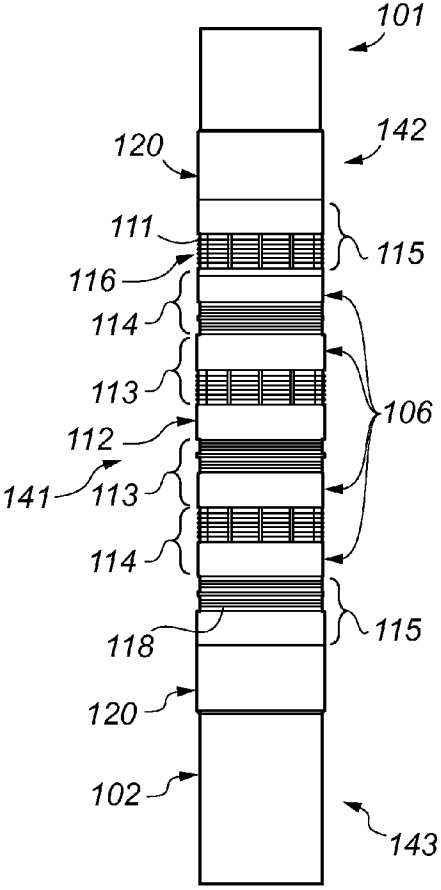
FIG. 5 is a schematic side view of a host tubular member of a further embodiment of an apparatus for connecting tubular members according to the present invention.

FIG. 5 shows another embodiment of the apparatus of the invention indicated generally 101. For brevity, in FIGS. 4 and 5 the same reference numerals are used to denote elements common to the two embodiments. In FIG. 5, the rings 106 are arranged in a predetermined sequence so that the resistance to radial loads of each subsequent annular member 106 increases progressively from a middle region 141 of the expandable portion 104 towards opposite ends 142, 143 of the expandable portion 104. The rings 106 together with recesses 111 define on the expandable portion 104 annular regions 112, 113, 114, 115 having differing resistance to the radial load. The region 112 defined by a central annular ring 106 has the lowest resistance and thus starts expanding before the regions 113, 114, 115 which have greater resistance when the expandable portion 104 is subjected to radial outward expansion. The regions 113 have still lower resistance than regions 114, which in turn are weaker than regions 115. Thus the region 112 (central ring 106) starts expanding before the regions 113, the regions 113 expand before the regions 114 and so on. Thus, the weakest region 112 seals against the inner surface or bore of the second tubular member before the stronger regions 112,113 and 114 with the strongest regions 115 being the last to expand.

In the embodiments of FIGS. 4 and 5, the arrangement of the rings 106 in the described above predetermined sequence so that their strength increases progressively from the centre to the ends 142, 143 causes fluid to be continuously expelled from the interface between the expandable portion 104 and the second tubular member as the expandable portion 104 expands, so that by the time the distal and strongest region 144 expands all the fluid has been forced out, thereby preventing the occurrence of a hydraulic lock.

In the embodiments of FIG. 4 and FIG. 5, the rings 106 are fixed on the host tubular member 102 in a suitable manner, such as, for example, but not limited thereto, via interference fit, welding, threaded connection, or some other method, or can be held in place by an external device (not shown).

The rings 106 may be installed by sliding them over or by clamping radially around the host tubular member 102.

The rings 106 may be made, for example, from metal, ceramics or composite material. Although not shown in the drawings, the rings 106 can be composed from an assembly of annular sub-members.

The resistance to the radial load of the regions 108, 109, 110 and 112, 113, 114, 115 can be adjusted by, for example, varying radial or axial thickness, or the overall size and shape, of the rings 106, varying the material of the rings 106, varying the spacing between the rings 106, providing the recesses 111 or rings 106 with other elements influencing the strength of the regions 108, 109, 110 and 112, 113, 114, 115, or a combination of the above.

In the embodiment of FIG. 5, gripper elements 116 and sealing elements 118 are alternately mounted between the rings 106. The gripper elements 116 are configured to resist axial and/or rotational movement of the host tubular member 102 by gripping an inner surface of the second tubular member. The sealing elements 118 provide an additional fluid and pressure seal.

The gripper elements 116 and the sealing elements 118 may be made, for example, from metal, ceramics, elastomeric or composite material. Other materials such as, for example, syntactic foam may improve sealing performance of the sealing elements 118 by providing potential extra volume for the host tubular member 102 to expand between the annular rings 106 and increase the interface pressure between the host tubular member 102, the sealing element 118 and the second tubular member.

Figure 6:
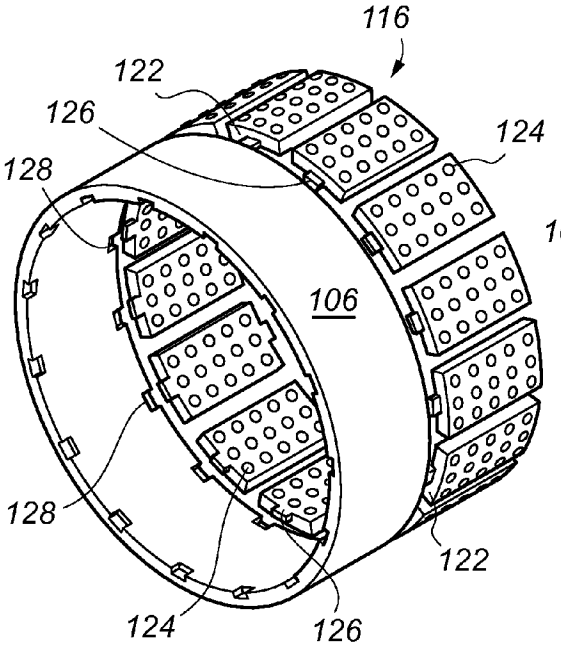
FIG. 6 is a schematic perspective view of a gripper element used with the host tubular member of FIG. 5.

FIG. 6 shows a possible embodiment of a gripper element 116 in more detail. The gripper element 116 comprises a ring formed from a plurality of gripping pads 122. Each pad 122 is retained in position by way of radial inward and outward protrusions 124 and keys 126 mating with corresponding keyways 128 in a neighbouring ring 106. The gripper elements 116 may be configured to engage the host tubular member 102 via an interference fit. Alternatively or additionally, although not shown in the drawings, the gripper element 116 may be configured to engage the host tubular member 102 and/or the second tubular member via one or more angled faces. Although not shown in the drawings, the host tubular member 102 or the second tubular member may comprise profiled or roughened surfaces to facilitate resistance to axial and radial displacement of the host tubular member 102.

The sealing elements 118 are profiled in an appropriate way to create a seal between the sealing elements 118 and the host tubular member 102 and the sealing elements 118 and the second tubular member 102. The sealing elements 118 can be configured to engage the host tubular member 102 via an interference fit.

In FIG. 4, a retaining nut 120 is provided at one end of the expandable portion 104 for keeping the rings 106 in their respective positions on the expandable portion 104. In FIG. 5, a pair of retaining nuts 120 is provided, one at each end 142, 143 of the expandable portion 104. The retaining nuts 120 keep the rings 106, the gripper elements 116 and the sealing elements 118 in their respective positions on the expandable portion 104.

If a hydraulic expansion tool is used, the rings 106 can be profiled or channelled (not shown) to facilitate fluid expulsion.

The host tubular member 102 could be any sort of tubing used downhole, for example, casing, liner or production tubing, etc. which needs to be expanded against another larger diameter tubing and can therefore be the same sort of tubing as used elsewhere in the tubing string. In any event, the host tubular member 102 will likely be at least as strong as the rest of the tubing string such that it at least matches the burst, collapse and axial load requirements for the tubing string as a whole.

Whilst specific embodiments of the present invention have been described above, it will be appreciated that modifications are possible within the scope of the present invention. The outer tubular sleeve may have a profile to define further annular regions having differing resistance to the radial load in addition to the reinforcing annular members. Additionally, the tubular members may be expandable tubular members where the expandable portion is placed within the second tubular member through a threaded connection i.e. the pin section, with the pin section comprising one or more reinforcing annular members mounted around the expandable connection.

We claim:

1. An apparatus for connecting tubular members in a wellbore, the apparatus comprising:

a host tubular member for sealingly connecting with a second tubular member, the host tubular member comprising:— a tubular body having an expandable portion adapted to be placed within the second tubular member and being expandable radially outwardly against the second tubular member by imposing radial force within said expandable portion, until one or more sealed joints are formed between the expandable portion and the second tubular member, said one or more sealed joints forming a pressure seal and an axial connection between said host tubular member and said second tubular member;

the expandable portion comprising one or more reinforcing annular members mounted around the outer circumference of at least a portion of the axial length of the expandable portion;

said one or more reinforcing annular member providing resistance to radial load and defining on the expandable portion one or more annular regions having differing resistance to the radial load, whereby at least one region having lower resistance expands prior to another region having greater resistance when the expandable portion is subjected to radial outward expansion, said expandable portion expanding first elastically and then plastically against said second tubular member, and wherein said one or more reinforcing annular members are arranged in a predetermined sequence, with each subsequent reinforcing annular member having a progressively increased resistance so that the expandable portion starts expanding at a weakest region first and continues to expand sequentially towards a strongest region.

2. An apparatus according to claim 1 wherein the resistance of each subsequent reinforcing annular member increases progressively from a middle region of the expandable portion towards outer ends of the expandable portion.

3. An apparatus according to claim 1 wherein the resistance of each subsequent reinforcing annular member increases progressively from one end of the expandable portion towards another.

4. An apparatus according to claim 1 wherein at least the expandable portion of the host tubular member has a uniform wall thickness.

5. An apparatus according to claim 1 wherein said one or more reinforcing annular members are fixed on the host tubular member.

6. An apparatus according to claim 1 wherein one or more annular gripper elements are mounted on the expandable portion.

7. An apparatus according to claim 1 wherein one or more sealing elements are mounted on the expandable portion.

8. An apparatus according to claim 1 wherein a plurality of said reinforcing annular members are arranged axially spaced apart on the expandable portion to define annular recesses between the reinforcing annular members, each annular recess having sides defined by end portions of adjacent reinforcing annular members and a base defined by an intermediate portion of the host tubular member bounded by the adjacent reinforcing annular members, and wherein a resistance of each subsequent reinforcing annular member and a subsequent recess on the expandable portion increases progressively so that the expandable portion as a whole starts expanding at the weakest region first and continues to expand sequentially towards the strongest region.

9. An apparatus according to claim 8 wherein gripper elements and sealing elements are mounted in the annular recesses with the gripper elements alternating with the sealing elements.

10. A method of connecting tubular members in a wellbore, the method comprising the steps of:—

(a) providing a host tubular member for sealingly connecting with a second tubular member, the host tubular member comprising a tubular body comprising an expandable portion;

(b) mounting one or more reinforcing annular members around the outer circumference of at least a portion of the expandable portion to provide annular regions within said expandable portion having differing resistance to radial load;

(c) placing the expandable portion within the second tubular member;

(d) expanding the expandable portion to elastically and then plastically deform radially outwardly against the second tubular member, with at least one region having lower resistance expanding prior to another region having greater resistance; and (e) forming one or more sealed joints between the expandable portion and the second tubular member, said one or more sealed joints forming a pressure seal and an axial connection between the expandable portion and the second tubular member.

11. A method according to claim 10 wherein in step (d) expansion occurs progressively from a middle region of the expandable portion towards outer ends of the expandable portion.

12. A method according to claim 10 wherein in step (d) expansion occurs from one end of the expandable portion towards another end.

13. A method according to claim 10 wherein step (d) includes causing fluid to be continuously expelled from the interface between the expandable portion and the second tubular member as the expandable portion expands.

14. A method according to claim 10 wherein the method further comprises the step of withstanding axial loads and fluid pressures acting between the host tubular member and the second tubular member.

15. A method according to claim 10 wherein the method includes the step of elastically deforming the material of the second tubular member.

16. A method according to claim 10 wherein step (b) comprises sliding the one or more reinforcing annular members over the host tubular member.

17. A method according to claim 10 wherein step (b) comprises clamping the one or more reinforcing annular members radially around the host tubular member.

* * * * *